US009426568B2

(12) United States Patent
Lakkundi et al.

(10) Patent No.: US 9,426,568 B2
(45) Date of Patent: Aug. 23, 2016

(54) APPARATUS AND METHOD FOR ENHANCING AN AUDIO OUTPUT FROM A TARGET SOURCE

(71) Applicant: Harman International Industries, Inc., Stamford, CT (US)

(72) Inventors: Ravi Lakkundi, Karnataka (IN); Srikanth Konjeti, Karnataka (IN); Anandhi Ramesh, Karnataka (IN)

(73) Assignee: Harman International Industries, LLC, Stamford, CT (US)

( * ) Notice: Subject to any disclaimer, the term of this patent is extended or adjusted under 35 U.S.C. 154(b) by 108 days.

(21) Appl. No.: 14/253,063

(22) Filed: Apr. 15, 2014

(65) Prior Publication Data

US 2015/0296289 A1 Oct. 15, 2015

(51) Int. Cl.
*H04R 3/00* (2006.01)

(52) U.S. Cl.
CPC ..... *H04R 3/005* (2013.01); *H04R 2499/11* (2013.01)

(58) Field of Classification Search
CPC .. H04R 3/005; H04R 1/406; H04R 2201/401; H04R 25/407; H04R 2201/403
See application file for complete search history.

(56) References Cited

U.S. PATENT DOCUMENTS 6,069,961 A * 5/2000 Nakazawa ..... H04R 3/005 381/122
6,549,630 B1 * 4/2003 Bobisuthi ..... H03G 3/32 381/106
6,757,397 B1 * 6/2004 Buecher ..... H04R 1/04 348/14.08
8,073,318 B2 12/2011 Gindele et al.
8,509,882 B2 8/2013 Albert et al.
2006/0133623 A1 * 6/2006 Amir ..... H04R 3/00 381/92
2008/0252595 A1 * 10/2008 Boillot ..... G06F 3/011 345/156
2008/0285772 A1 * 11/2008 Haulick ..... G01S 7/52003 381/92
2009/0207131 A1 * 8/2009 Togami ..... G06F 3/0416 345/156
2011/0069846 A1 * 3/2011 Cheng ..... H04R 3/005 381/92
2011/0085061 A1 * 4/2011 Kim ..... H04N 5/232 348/240.99
2012/0165042 A1 * 6/2012 Cho ..... G01C 21/165 455/456.1
2013/0055103 A1 * 2/2013 Choi ..... G06F 3/017 715/740
2013/0195296 A1 8/2013 Merks
2013/0281122 A1 * 10/2013 Zelinka ..... H04W 64/00 455/456.3

OTHER PUBLICATIONS

Greensted, Delay Sum Beamforming, The Lab Book Pages, 2012, 6 pages, <http://www.labbookpages.co.uk/audio/beamforming/delaySum.html>.
Van Veen et al., Beamforming: A Versatile Approach to Spatial Filtering, IEEE ASSP Magazine, 1988, pp. 4-24.
Rübsamen, Advanced Direction-of-Arrival Estimation and Beamforming Techniques for Multiple Antenna Systems, Darmstadt, Germany, 2011, 198 pages.
Adve, Direction of Arrival Estimation, University of Toronto, Canada, 2007, 25 pages.

* cited by examiner

*Primary Examiner* — Simon Sing
(74) *Attorney, Agent, or Firm* — Brooks Kushman P.C.

(57) ABSTRACT

A computer-program product embodied in a non-transitory computer read-able medium that is programmed for transmitting audio data to at least one output for audio playback. The computer-program product comprises instructions for receiving at least one of a digital image of a target source using a camera, and distance and angle information of the target source entered at a user interface. The computer-program product comprises instructions for generating one or more first coordinates based on the at least one of the digital image and the distance and angle information. The computer-program product comprises instructions for adjusting a sensitivity of a first microphone based on the one or more first coordinates. The computer-program product comprises instructions for receiving audio data from the target source in response to adjusting the sensitivity of the first microphone and transmitting the audio data to one or more outputs for audio playback.

23 Claims, 7 Drawing Sheets

APPARATUS AND METHOD FOR ENHANCING AN AUDIO OUTPUT FROM A TARGET SOURCE

TECHNICAL FIELD

The disclosure relates to a hearing assistance system and more particularly to an adaptive directional apparatus that utilizes adaptive beamforming to focus in a direction of a source of a target sound.

BACKGROUND

Among electronic devices, portable mobile devices include a telephone, camera, a microphone, and a speaker. The mobile device may have an operating system (OS) that can run various types of application software, known as apps. The mobile devices may be capable of performing communication through Wireless Fidelity (WiFi), or $3^{rd}$ Generation (3G), $4^{th}$ Generation (4G) network, with neighboring devices through a Bluetooth module, and Near Field Communication (NFC). In addition, a variety of location information services can be accessed using the mobile device by simultaneously employing a Global Positioning System (GPS) module, a terrestrial magnetism sensor, or an ambient light sensor, etc. The mobile device may allow a user to capture a High Definition (HD) video by using a digital camera, to listen to the music by using an MPEG Audio Layer-3 (MP3), and to enjoy a video file by storing the file onto an internal memory without an additional encoding process.

With more advanced computing capability and connectivity, mobile devices have become popular in society. In addition, the functionality of the mobile device and the rapid development of mobile applications are additional attributes that have contributed to the popularity of owning a mobile device.

SUMMARY

In a first illustrative embodiment, a computer-program product embodied in a non-transitory computer read-able medium that is programmed for transmitting audio data to one or more outputs for audio playback. The computer-program product comprises instructions for receiving at least one of a digital image of a target source using a camera, and distance and angle information of the target source entered at a user interface. The computer-program product further comprises instructions for generating one or more first coordinates based on the at least one of the digital image and the distance and angle information. The computer-program product further comprises instructions for receiving audio data from the target source in response to adjusting a sensitivity of a first microphone based on the one or more first coordinates and transmitting the audio data to one or more outputs for audio playback.

In a second illustrative embodiment, a mobile device for receiving audio data from a target source for playback at one or more outputs. The mobile device includes a camera and at least one control module. The at least one control module configured to receive a digital image of a target source from the camera and generate one or more first coordinates based on the digital image. The at least one control module further configured to receive audio data from the target source in response to adjusting a sensitivity of a first microphone based on the one or more first coordinates and transmit the audio data to one or more outputs for audio playback.

In a third illustrative embodiment, a method for transmitting audio data to one or more outputs for audio playback. The method may receive, via a control module, at least one of a first digital image of a target source from a camera and distance and angle information of the target source at a user interface. The method may generate one or more first coordinates based on the at least one of the first digital image and the distance and angle information. The method may receive audio data from the target source in response to adjusting the sensitivity of the microphone and transmit the audio data to one or more outputs for audio playback.

DETAILED DESCRIPTION

Figure 1A:
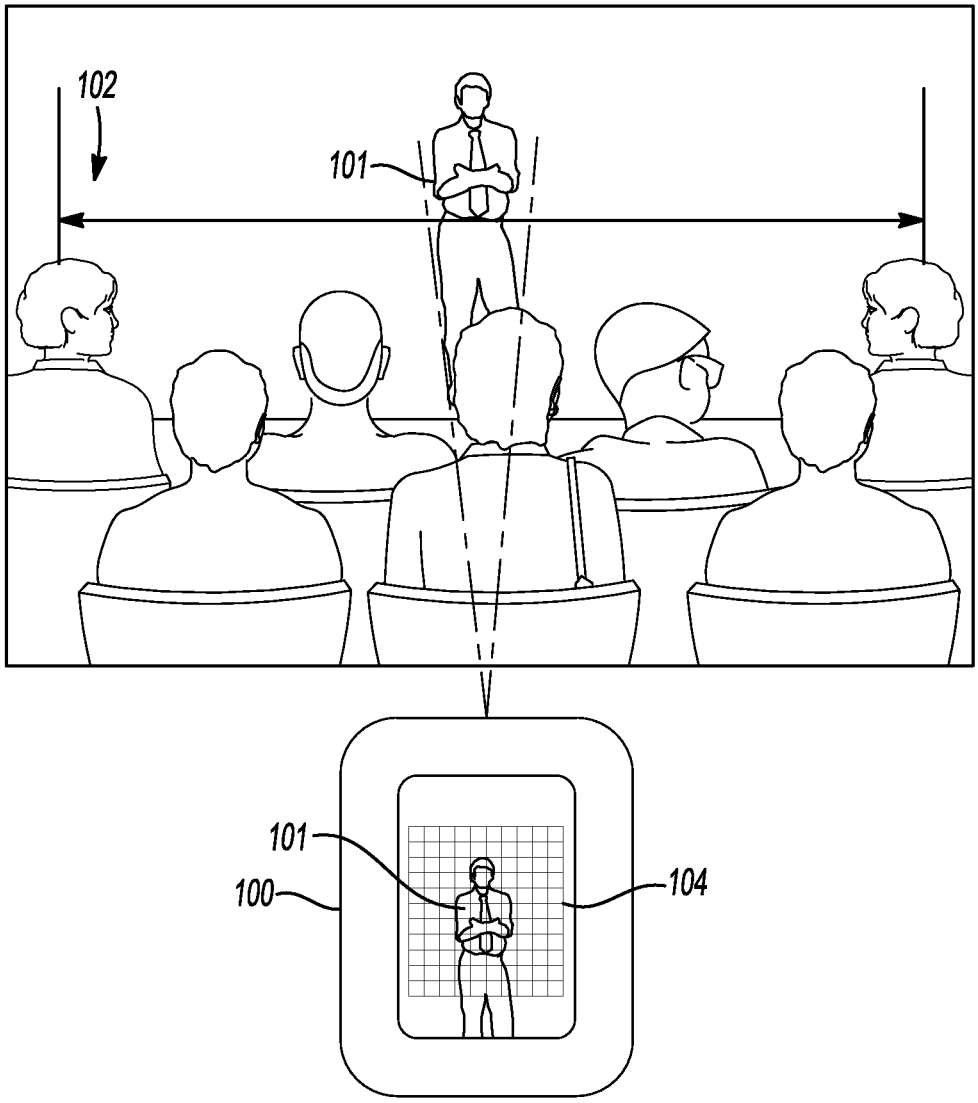
FIGS. 1A-1C depict various diagrams illustrating a capture scenario of a target source according to an embodiment.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The embodiments of the present disclosure generally provide for a plurality of circuits or other electrical devices. All references to the circuits and other electrical devices and the functionality provided by each, are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired. It is recognized that any circuit or other electrical device disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electric devices may be configured to execute a computer-program that is embodied in a non-transitory computer readable medium that is programmed to perform any number of the functions as disclosed.

In public spaces such as a cafeteria, a community hall, airport, and/or auditorium, it may become difficult to listen to a presenter, watch a television, and/or hear an announcement over a public address system. It becomes difficult for a person to focus on listening to the content of what is being announced with the surrounding noise. Therefore, an apparatus or method is needed to amplify a target source of sound that may be of interest to a user. It should also be noted that hearing loss may be sudden or gradual for older and elderly adults; therefore the apparatus or method may be used to assist a user with hearing impairment.

The apparatus may be implemented on a mobile device platform. The mobile device platform may include, but is not limited to, a smart phone, tablet, and/or laptop. The mobile device includes an adaptive beamforming method to aim/focus one or more microphones thereof toward the target source of the sound. The adaptive beamforming method may rely on the principals of wave propagation and phase relationships. For example, the adaptive beamforming method may determine the sensitivity of sound arrival from the target source of sound using one or more microphones. The adaptive beamforming method may adjust the delay of the one or more microphones to increase the static to noise ratio (SNR) from the target source direction based on the sensitivity of sound arrival. The adaptive beamforming method may calculate the arrival of sound form the one or more microphones based on an equation having several variables that include, but is not limited to, a signal frequency, arrival angle, speed of sound, and the number of microphones on the mobile device. The adaptive beamforming method may be improved by including additional variables in the arrival of sound equation based on a captured image of the target source of sound, user input, or any combination thereof.

The mobile device uses adaptive beamforming to extract sound sources in a room, such as multiple speakers in an auditorium. The adaptive beamforming method determines the sensitivity of a microphone array for signals coming from a particular direction. Such a determination of the sensitivity of the microphone array for signals coming from a particular direction are applied with the adaptive beamforming method and may be used to aim/focus one or more microphones. The adaptive beamforming method may also reject unwanted sound from other directions.

The present disclosure provides a hearing assistant apparatus or an adaptive directional apparatus that, once executed on hardware, utilizes adaptive beamforming to provide hearing assistance with the use of a camera image, user input data, and/or one or more microphones. The apparatus may use data received from an image taken by the camera and/or user input data in combination with adaptive beamforming to provide speech detection and response. The adaptive beamforming includes combining signals from one or more microphones to amplify a sound signal from a target direction. The adaptive beamforming also includes amplifying sound while attenuating sound signals from other directions. The adaptive beamforming includes determining the target direction with the signals from the one or more microphones and may not take into account the nature of the incoming signals. The apparatus may reduce noise signals as well as speech signals that are not coming from the target direction.

The apparatus may provide for an improved calculation of the direction of the target source by allowing additional aim information to where the target is located by adjusting the sensitivity of the one or more microphones. The additional aim information generally includes distance, direction, angle, and/or position of the target source that may be calculated from an image and/or input received from a user interface. The additional aim information may be applied with an input from one or more microphones to the adaptive beamforming algorithm.

Figure 1B:
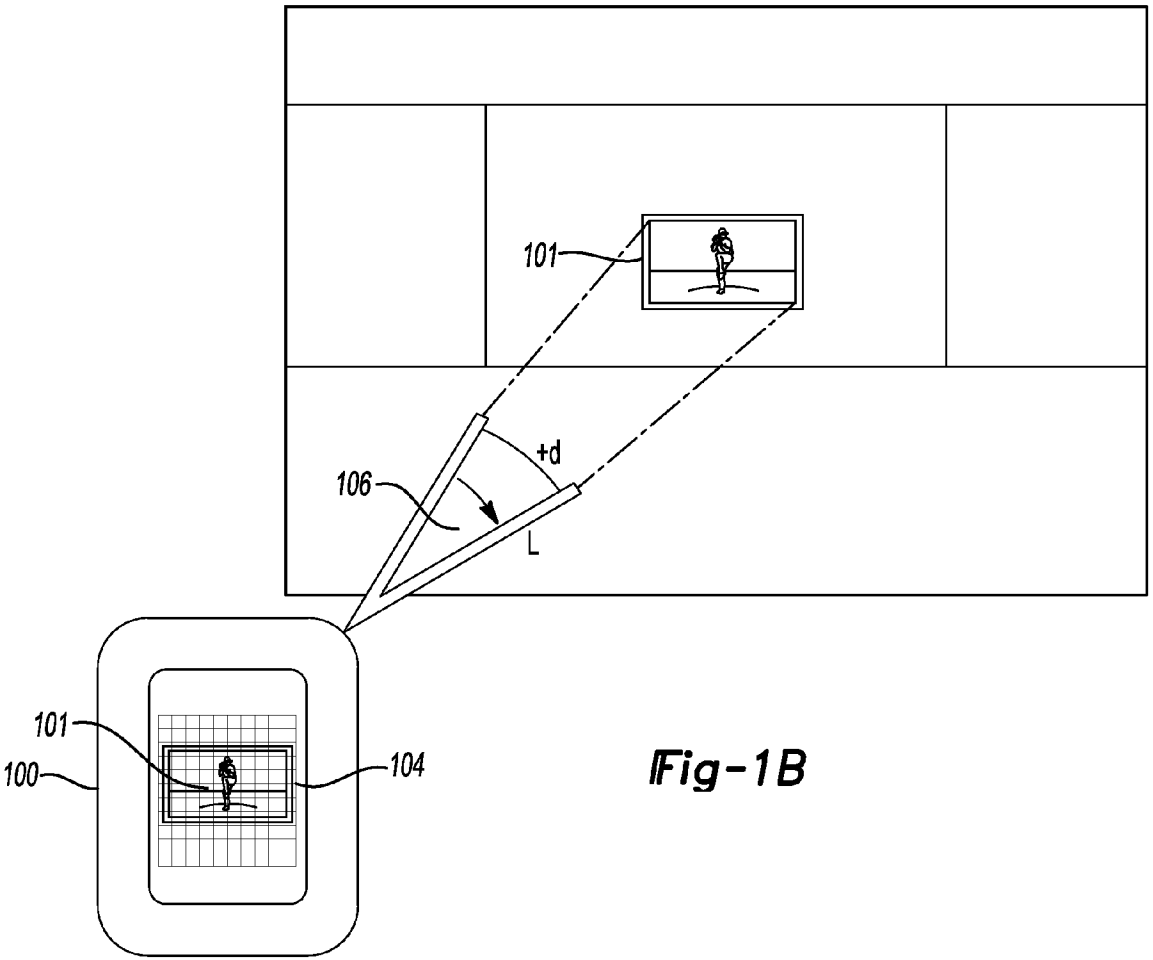
Figure 1C:
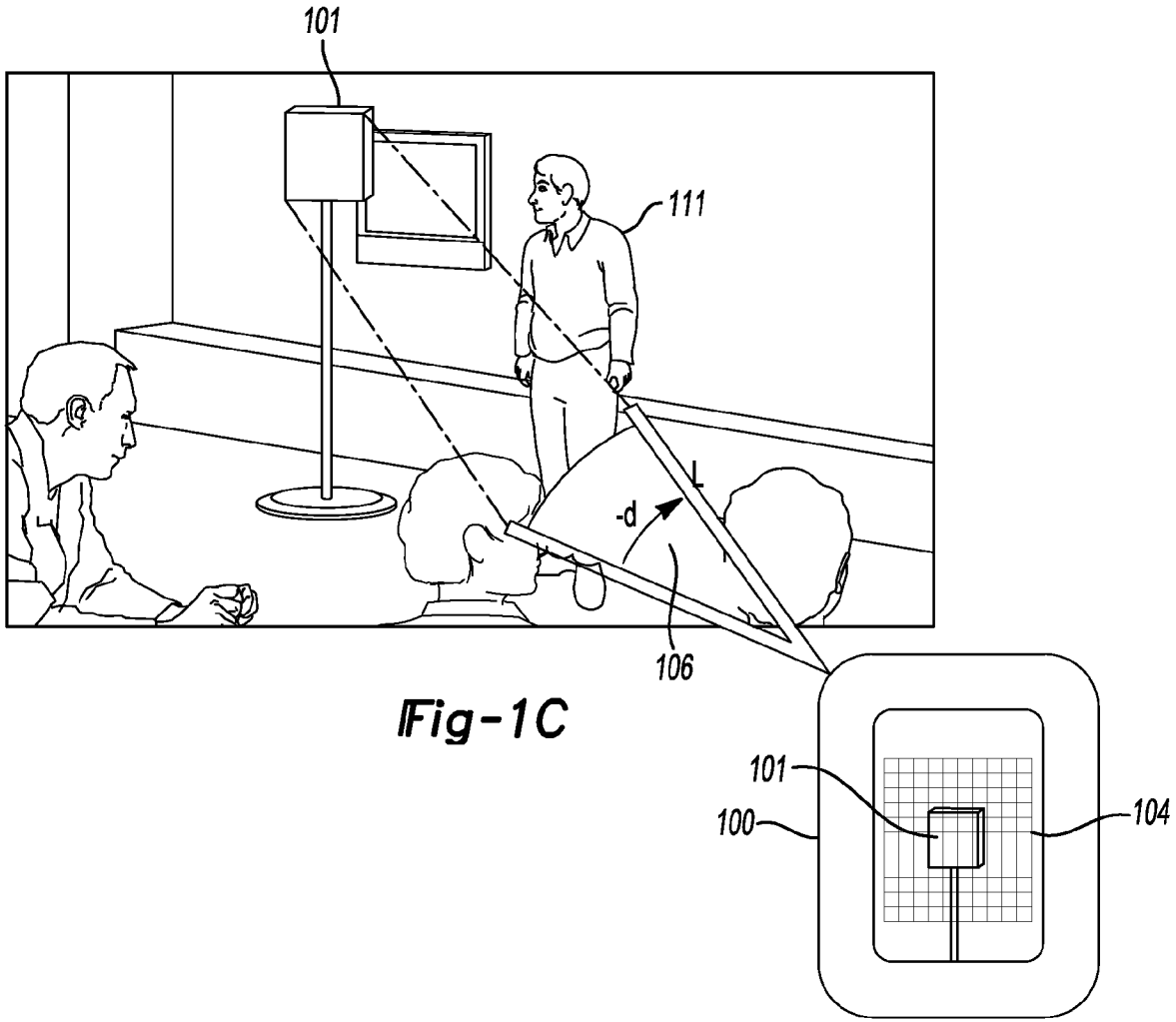

FIG. 1A-1C are diagrams illustrating a capture scenario of a target source 101 using a camera of a mobile device 100 according to an embodiment. The mobile device 100 includes any combination of hardware and software to execute a hearing assistant apparatus (and/or application) to assist in amplifying the target source 101 of sound. The camera may be integrated within the mobile device 100 to assist in determining the location of the target source 101 of sound.

The diagram in FIG. 1A illustrates the mobile device 100 capturing the target source 101 which is directly in front of the mobile device 100. The target source 101 may include a presenter that is stationary at a podium and/or a moving target. The mobile device 100 may provide a grid 104 on a display screen thereof to improve aiming of the mobile device 100 when capturing the image. For example when the mobile device 100 is being aimed towards the presenter, the gird 104 along with the target source 101 is provided on the display screen of the mobile device 100 as shown in FIG. 1A. The mobile device 100 may request additional information about the target source 101 including, but not limited to, if the target source 101 is stationary or a moving target. If the target source 101 is a moving target, the mobile device 100 may request additional information with regard to the movement settings including, but not limited to, the approximate length of allowed movement 102. The mobile device 100 may calculate the depth and angle information based on the camera image of the target source 101. The mobile device 100 may improve adaptive beamforming control by adjusting the sensitivity of one or more microphones positioned therein based on the calculate depth and angle form the camera image while using the input information regarding the movement area 102 of the target source 101.

The diagram of FIG. 1B illustrates a capture scenario of the target source 101 which is at a distance and positioned to the right of the mobile device 100. The target source 101 in this example may include a television or other suitable audio visual device that may be stationary. The mobile device 100 may prompt the display screen with the grid 104 in order to improve the aim of the camera when capturing the image. The grid 104 may also be configured to allow the mobile device 100 to improve the calculation of the direction, distance, and/or angle from the mobile device 100 to the target source 104. The mobile device 100 may calculate depth and angle information 106 based on the captured image of the target source 101. The mobile device 100 may improve the adaptive beamforming calculation for adjusting the sensitivity of the one or more microphones based on the calculated depth, distance, and/or angle position from the camera image. The mobile device 100 may use the layout/configuration of the grid 104 to improve the calculation for adjusting the sensitivity (e.g., aiming) of the one or more microphones.

The diagram of FIG. 1C illustrates a capture scenario of a target source 101 which is at a distance and positioned to the left of the mobile device 100. The target source 101 may be a speaker from an electronic sound amplification and distribution system that broadcasts audible data for a presenter 111. The mobile device 100 may provide the grid 104 on the display thereof to improve the aim of the camera on the mobile device 100 when capturing the target source 101 (e.g., the speaker). The mobile device 100 may calculate the height, depth, distance, and/or angle from the mobile device 100 to the target source 101. The mobile device 100 may also calculate the height, depth, distance, and/or angle information 106 based on the camera image of the target source 101. The mobile device 100 may improve the adaptive beamforming equation for adjusting the sensitivity of the one or more microphones based on the calculated information from the image. The mobile device 100 may employ adaptive beamforming with such information to improve the aim of one or more microphones thereof to the target source 101, therefore improving the audible reception of the speaker (or the target source 101).

Figure 2:
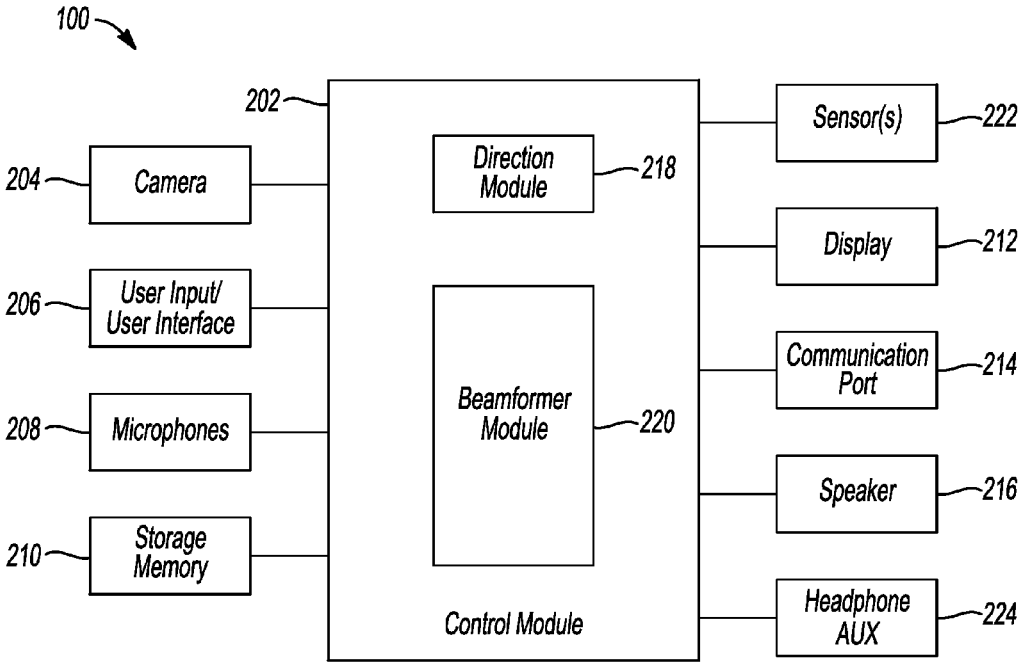
FIG. 2 depicts a block diagram of a mobile device according to an embodiment.

FIG. 2 is a block diagram illustrating the mobile device 100 having adaptive direction control according to an embodiment. The mobile device 100 is generally configured to amplify sound from the target source 101 to assist a user in listening to content that is being broadcast over surrounding noise. The mobile device 100 generally includes a control module 202 (e.g., at least one processor), one or more microphones 208, a camera 204, storage memory 210 (e.g., internal or external to the mobile device 100), a display 212, a user interface 206, a communication port 214, an input sensor 222, a speaker 216, and/or a headphone aux 224. The one or more microphones 208 may receive the sounds from the target source 101. The control module 202 may process the received sounds and perform adaptive beamforming with the use of a beamformer module 220 based on data received from one or more sources including, but not limited to, the input sensor 222, user input received at the user interface 206, and/or a received image taken by the camera 204. Such data may allow the mobile device 100 to determine the distance, direction, angle, height and/or overall position of the target source 101. Data received from the camera 204 and/or user input 206 may provide additional parameters for adaptive beamforming to adjust the sensitivity for aiming or directing the one or more microphones 208 toward the target source 101.

The mobile device 100 may use the data from the input sensor 222, the user interface 206, and/or the camera 204 to determine a distance, direction, and angle of the target source 101 of sound. The camera 204 may provide an image of the target source 101 and from the image, the mobile device 100 may determine the distance to the target source 101 by using several mathematical equations including, but not limited to:

$$\text{distance (mm)} = \frac{\text{focal length}_x\text{ (mm)} * \text{real height of the object (mm)} * \text{image height (pixels)}}{\text{object height (pixels)} * \text{sensor height (mm)}} \tag{1}$$

where the mobile device 100 may request an estimated real height of the object at the user interface 206. The ratio of the size of the object on a sensor of the camera 204 and the size of the object in real life is the same as the ratio between the focal length and distance to the object. Another example of calculating distance to the target source 101 with an image taken by the camera 204 may include, but is not limited to:

$$\frac{x}{f} = \frac{X}{d} \tag{2}$$

where x is the size of the object on the sensor, f is focal length of the lens, X is the size of the object, and d is the distance from the mobile device 100 to the target source 101. The size of the object X may be determined by, but is not limited to, requiring the mobile device 100 to obtain two or more images of the target source 101 within the same line of sight, but at slightly different distances. For example, consider $$\frac{x_1}{f} = \frac{X}{d_1} \tag{3}$$

$$\frac{x_2}{f} = \frac{X}{d_1} \tag{4}$$

where a first photo of a target source 101 includes a first image size $x_1$, and a distance $d_1$. Further, a second photo is at s distance (e.g., millimeters, meters, etc. . . . ) closer to the target source 101 and includes a second image size $x_2$ and a distance $d_2$. In this case, the second image size $x_2$ may be slightly larger than the first image size $x_1$. Therefore the distance may be calculated using the following equation:

$$d_1 = s \times \frac{x_2}{x_2 - x_1} \tag{5}$$

The mobile device 100 may use the received data from the input sensor 222, user interface 206, and/or camera 204 to determine a distance, direction, and/or angle of the target source 101 of sound. The data may be used to calculate a location/direction of the target source 101 by implementing different techniques to measure the distance and/or angle of the target source 101. The mobile device 100 may employ any one or more of the following techniques to measure the distance and/or angle of the target source 101: object placement in the image, other objects in the frame, sharpness of the actual object relative to the nearest object, and/or edge detection and angle determination. The camera 204 may provide an image of the target source 101 and from the image the control module 202 may determine the angle to the target source 101 by using several mathematical equations including, but not limited to:

$$\sin\theta = \frac{-d}{L} \tag{6}$$

$$\sin\theta = \frac{d}{L} \tag{7}$$

where d is direction of the target source 101 and L is the distance as shown as the depth, distance and angle information 106 (see FIG. 1B-1C). The negative sin θ in equation (6) may be used for the target source 101 that is to the left of the mobile device 100 as shown in FIG. 1C. The sin θ in equation (7) may be used for the target source 101 that is to the right of the mobile device 100 as shown in FIG. 1B. The mobile device 100 may determine boundaries/edges of the target source 101 to determine at least one of direction, distance, and angle. For example, the mobile device 100 may determine the upper corner of the target source 101 to find the angle between the virtual straight line and the edges of the target source 101.

The mobile device 100 may request user input of one or more parameters at the user interface 206 to also determine the distance to the target source 101 in combination with, or in the absence of, having the mobile device 100 take a picture of the target source 101 using the camera 204. The request for user input 206 may be presented and received on the display 212 of the mobile device 100. The user input 206 may include, but is not limited to, an estimated position, angle, height, and/or distance of the target source 101. The display 212 may have an integrated user interface 206 by including a touch screen, keyboard, mouse, and/or a combination thereof. The mobile device 100 may obtain position information as input to adaptive beamforming with the use of input sensors 222 to determine position of the target source 101 in relation to the mobile device 100. The input sensors 222 may include, but is not limited to, a gyroscope and/or an accelerometer to provide such mobile device position information.

The beamformer module 220 may adjust the sensitivity of the one or more microphones 208 for controlling the one or more microphones 208 toward the target source 101 (or provide a target direction for the one or more microphones 208 with respect to the target source 101). The beamformer module 220 may include a speech detector (not shown) and/or a steering module (not shown). The beamformer module may adjust the sensitivity of one or more microphones to allow signals from the target source to arrive at the same time in a signal array to generate a maximum amplified output. The beamformer module 220 may cancel sounds that are not from the target source 101 via the adaptive beamforming. For example, the speech detector may detect an off-axis speech or speech that is not from the target source 101. The steering module may receive the detected off-axis speech signals by adjusting the sensitivity of one or more microphones. The beamformer module may eliminate the off-axis signals from the received target source signals when generating the maximum amplified output, therefore substantially reducing the cancellation of the off-axis speech.

The memory 210 is in communication with the control module 202 and is a computer-readable storage medium that may store a set of instructions including direction instructions, signal processing, beamforming, and/or speech detector instructions. The mobile device 100 includes any hardware for executing such set of instructions. The hardware may include, but is not limited to, a direction module 218. The direction module 218 may calculate direction of the target source 101 in relation to the mobile device 100 based on the image of the target source 101 and/or the depth, distance, and angle information 106 received from the user interface 206.

Figure 3:
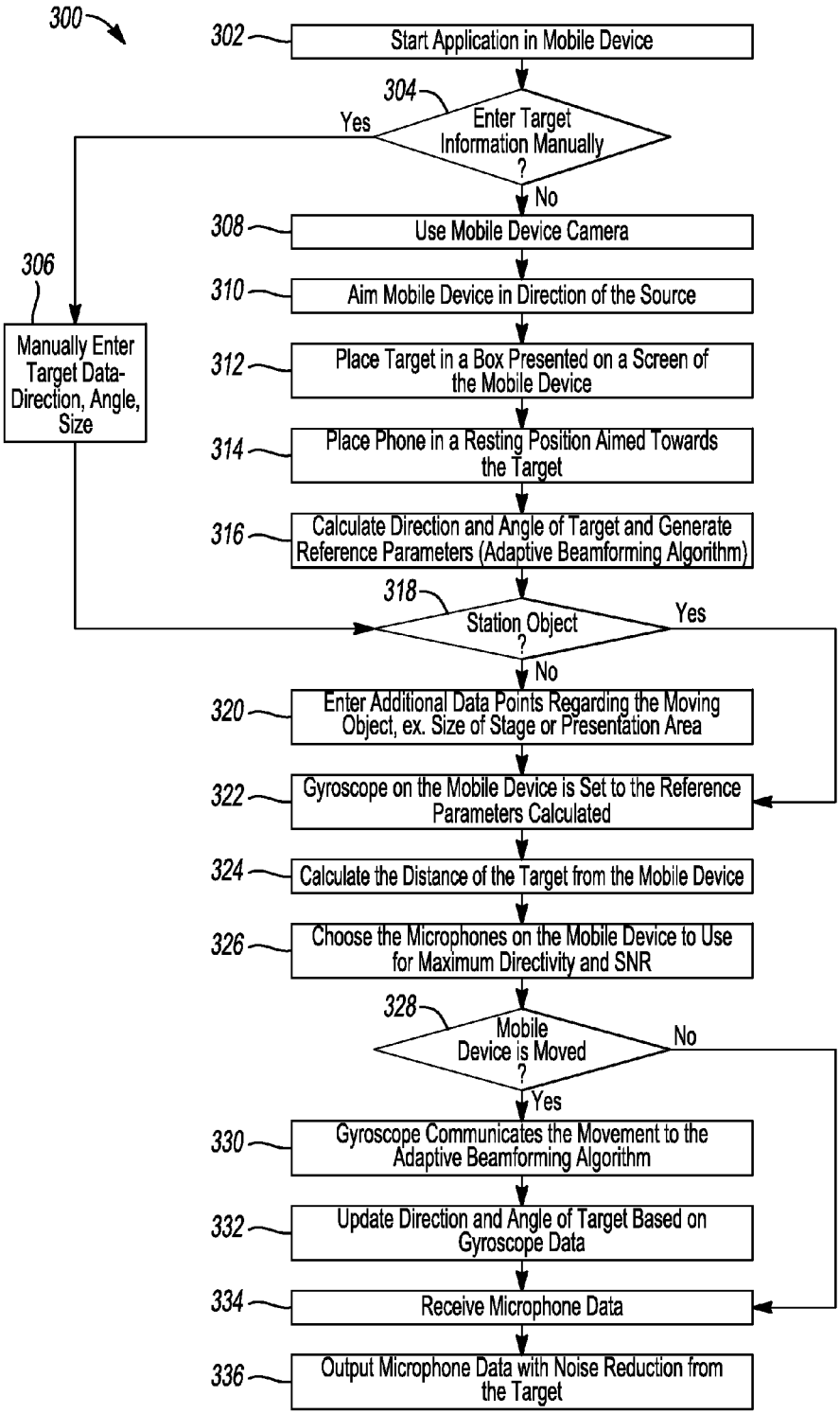
FIG. 3 depicts a flow chart illustrating a method for operating a hearing assistance system with the mobile device according to an embodiment.

FIG. 3 is a flow chart illustrating a method 300 for executing the hearing assistance application with the mobile device 100 according to an embodiment. Although the various operations shown in the flowchart diagram 300 appear to occur in a chronological sequence, at least some of the operations may occur in a different order, and some operations may be performed concurrently or not at all.

In operation 302, the mobile device 100 initiates execution of the hearing assistance application via hardware thereof. The mobile device 100 may request target source 101 information by transmitting a message to the display 212. The requested target information may include the option of taking a photographic image of the target source 101 using the device camera 204 and/or requesting target source 101 coordinate data at the user interface 206. The mobile device 100 may allow for the target source 101 data to be entered manually at the user interface 206/display 212 or the mobile device 100 may determine the target information automatically via the photographic image taken with the camera 204 as set forth in operation 304.

In operation 306, the mobile device 100 may receive manually entered target data including, but not limited to, direction, angle, and/or distance information from the mobile device 100 to the target source 101. The camera 204 captures an image of the target source 101 in operation 308.

In operation 310, the mobile device 100 is aimed in the direction of the target source 101. The mobile device 100 may use additional input sensors 222 (e.g., gyroscope) to determine position of the mobile device 100 when it is being aimed in the direction of the target source 101. The mobile device 100 may present a grid screen 104 on the display 212 to assist a user in aiming the mobile device 100 in the direction of the target source 101 as set forth in operation 312. An image taken within the grid screen 104 provides the mobile device 100 the ability to determine direction, angle, and/or distance the target source 101 is from the mobile device 100. The mobile device 100 may request one or more images to determine the distance from the mobile device 100 to the target source 101 based on the location of the target source 101.

In operation 314, once the imagine(s) has been recorded, the mobile device 100 may be placed in a resting position aimed towards the target source 101 such that the mobile device 100 may determine the adjusted sensitivity for controlling the aim of the one or more microphones 208 towards the target source 101. The mobile device 100 may determine direction, distance, and/or angle of the target source 101 and generate reference parameters for use during adaptive beamforming. For example, the reference parameters may be used to adjust the delays between the one or more microphones 208 to the target source 101 such that the signal from different microphones is superimposed on each other creating a signal of higher SNR as set forth in operation 316.

In operation 318, the mobile device 100 may request input information regarding whether the target source 101 is a stationary target or a moving target. For example, if the target source 101 is a stationary target such as a television mounted to a wall, then the mobile device 100 may know that the adjusted sensitivity of the one or more microphones 208 may be aimed at that specific location. If the target source 101 is a moving target such as a presenter that is on a stage, then the mobile device 100 may request input information that may include, but is not limited to, the size of the stage or presentation area in operation 320. The input information may allow the mobile device 100 to provide a buffer zone such that the adaptive beamforming of the one or more microphones 208 may adjust based on the moving target dimensions (e.g., size of stage).

In operation 322, the mobile device 100 is placed in a resting position aimed towards the target source 101 and the gyroscope on the mobile device 100 is set to the reference parameters determined by the resting position. The gyroscope may be used as an input sensor 222 for feedback detection to the adaptive beamforming module to determine if the mobile device 100 is moved from the resting position. The mobile device 100 may determine and update the distance/angle/direction of the target source 101 from the mobile device 100 based on the gyroscope data, manually entered data, and/or the captured image data of the target source 101 as set forth in operation 324.

In operation 326, the mobile device 100 may choose the aim direction of the one or more microphones 208 to use for maximum directivity. The mobile device 100 may adjust the sensitivity of the one or more microphones 208 to improve signal-to-noise ratio. For example, two microphones 208 may have the sensitivity adjusted such that their microphone signals arrive at the same time from the target source 101, therefore the signals are aligned before they are summed creating the desired sound for amplification. While the two microphones signal are aligned for amplification, there may be other microphones on the mobile device 100 adjusted to reduce unwanted surrounding noise via adaptive beamforming.

In another example, the mobile device 100 may receive audio data from the target source 101 using a first microphone via adaptive beamforming such that a first amplitude is generated based on the audio data. The mobile device 100 may receive an off-axis noise using a second microphone via adaptive beamforming such that a second amplitude is generated based on the off-axis noise. The mobile device 100 may determine a difference between the first amplitude and the second amplitude to provide a resultant amplitude. The resultant amplitude may be applied to the first amplitude to increase the signal-to-noise ratio of the audio data from the target source 101.

In operation 328, the mobile device 100 may monitor movement using one or more input sensors 222. If the mobile device 100 detects movement, the mobile device 100 may receive data from the gyroscope with regard to the movement to update the adaptive beamforming determination in operation 330.

In operation 332, the gyroscope may transmit the movement of the mobile device 100 such that the direction and angle of the target source 101 from the mobile device 100 may be updated based on the movement. The mobile device 100 may continue to receive microphone data (e.g., signals) form the one or more microphones 208 aimed in the direction of the target source 101 as set forth in operation 334. The mobile device 100 may output the microphone data from the target source 101 to one or more outputs including, but not limited to, a speaker 216 in communication with the mobile device 100 and/or a headphone auxiliary jack 224 configured with the mobile device 100 as set forth in operation 336. The microphone data may include noise reduction of the sound surrounding the mobile device 100 based on one or more microphones 208 positioned away from the target source 101.

Figures 4A, 4B, 4C:
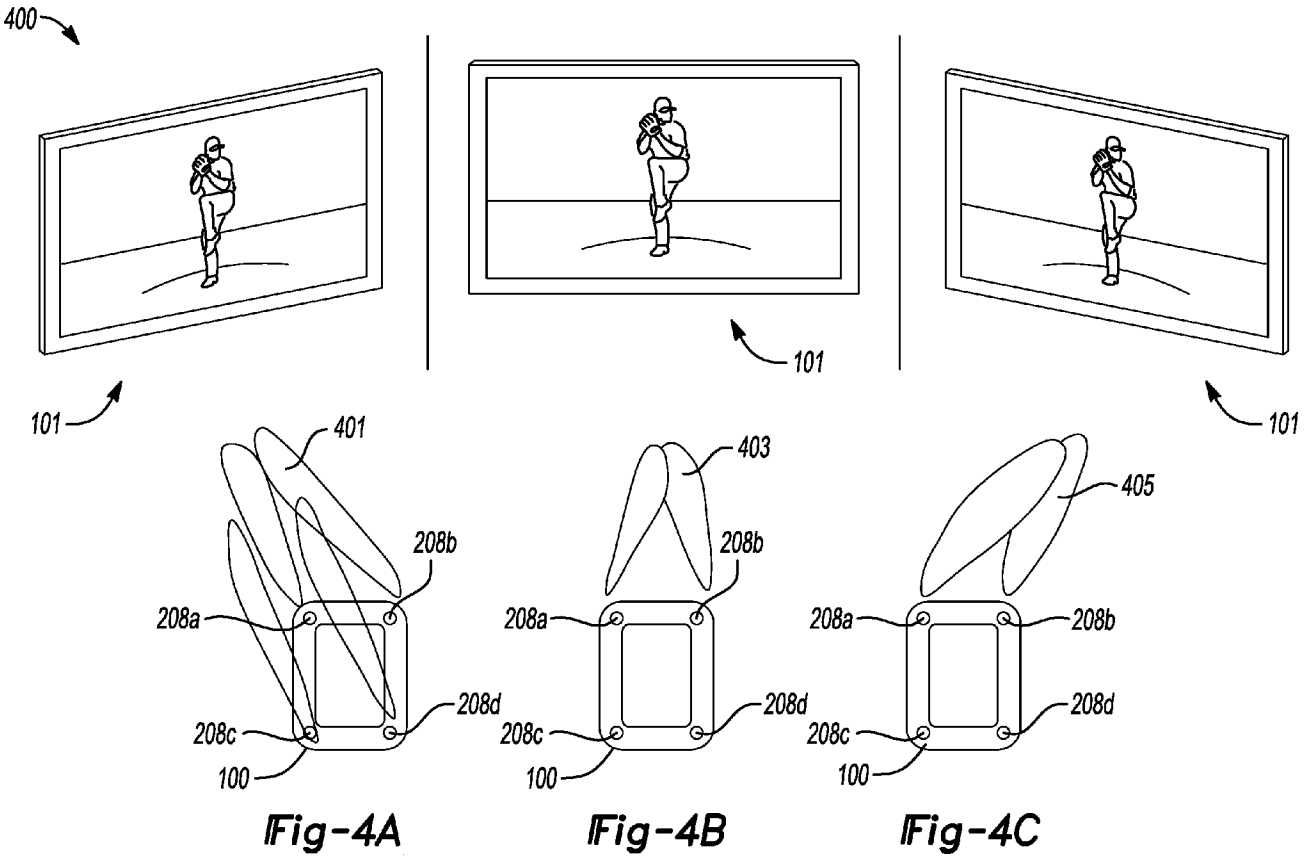
FIGS. 4A-4C depict various diagrams illustrating the mobile device forming a beam in the direction of the target source according to an embodiment.

FIG. 4A-4C are diagrams 400 illustrating the mobile device 100 forming a beam in the direction of the target source 101 according to an embodiment. The mobile device 100 may have microphones positioned throughout the device. In this example, the mobile device 100 may have four microphones 208 located at each corner of the mobile device 100. For example, microphone 208*b* may be located at the right top corner, microphone 208*a* may be located at the left top corner, microphone 208*d* may be located at the right bottom corner, and microphone 208*c* may be located at the left bottom corner.

In FIG. 4A, the target source 101 may be located to the left of the mobile device 100. The mobile device 100 may capture an image of the target source 101 and based on the image calculate distance, angle, and/or height of the target source 101 from the mobile device 100. Based on the calculation of the target source 101 positioned to the left of the mobile device 100, the adaptive beamforming may adjust the sensitivity of the four microphones 208 to aim 401 towards the target source 101 of desired sound. For example, the left top corner microphone 208*a* may receive the audio data signal first before the right top corner microphone 208*b*, and left bottom corner microphone 208*c* may receive the audio data signal before the right bottom corner microphone 208*d*. Therefore, the adaptive beamforming may adjust the sensitivity of the four microphones to delay the arrive of the audio data signals such that the audio data signals from the target source 101 are receive at the audio array at the same time for generating a maximum output amplitude.

In FIG. 4B, the mobile device 100 may be located directly in front of the target source 101. The mobile device 100 may capture an image of the target source 101 to calculate distance, angle, and/or height from the desired source of sound to the mobile device 100. Based on the calculation of the target source 101 positioned to the center of the mobile device 100, the adaptive beamforming control of the microphones 208 may only require adjusting the sensitivity of the two front microphones 208*a* 208*b* to aim 403 towards the target source 101.

In FIG. 4C, the target source 101 may be located to the right of the mobile device 100. The mobile device 100 may capture an image and/or receive input from a user interface 206 to calculate distance, angle, and/or height of the target source 101 in relation to the mobile device 100 position. Based on the calculation of the target source 101 positioned to the right of the mobile device 100, the adaptive beamforming control of the microphones 208 may only require adjusting the sensitivity of the two front microphones 208*a* 208*b* to aim 405 towards the target source 101. For example, the right top corner microphone 208*b* may receive the audio data signal first before the left top corner microphone 208*a*. Therefore, the adaptive beamforming may adjust the sensitivity of the right top corner microphone 208*b* to delay the arrive of the signal such that the audio data signals from the target source 101 are receive at the audio array at the same time for generating a maximum output amplitude.

Figure 5:
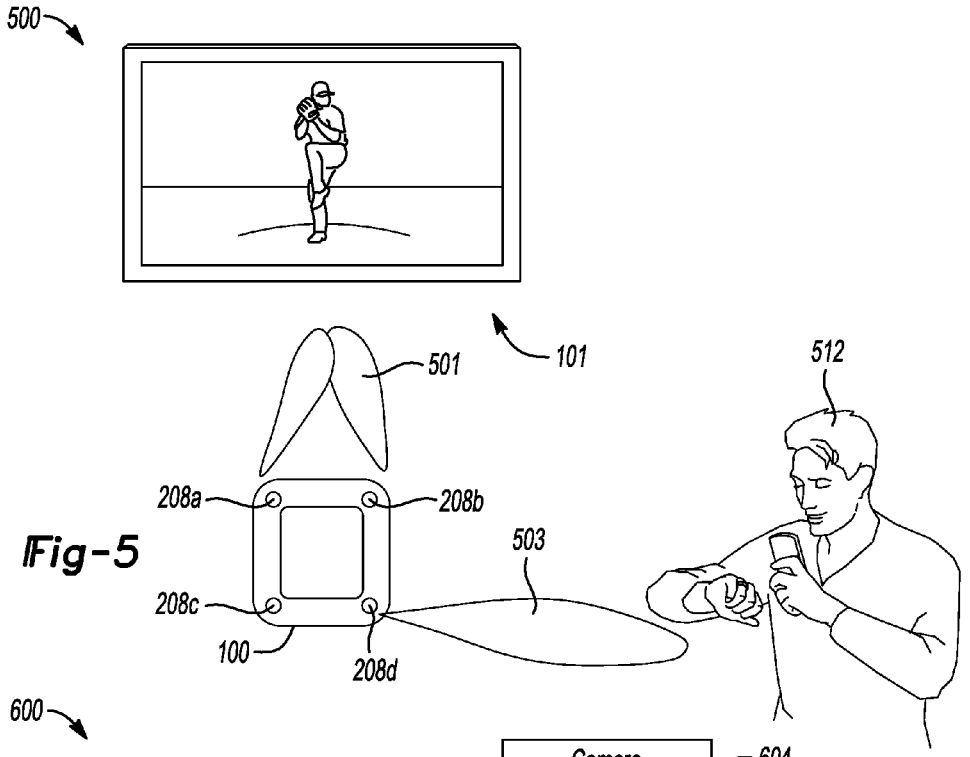
FIG. 5 depicts a diagram illustrating an off-axis noise detector for defusing detected noise that is not received from the target source according to an embodiment.

FIG. 5 is a diagram 500 illustrating an off-axis noise detector for defusing detected noise that is not received from the target source 101 according to an embodiment. The mobile device 100 may adjust the sensitivity and delay between the target source 101 and the one or more microphones 208 to develop the cancelation of surrounding noise. The cancelling of the surrounding noise may improve the amplified sound of the target source 101.

The mobile device 100 may include, but is not limited to, having microphones 208 located at each corner of the mobile device 100. The mobile device 100 may capture an image and/or receive user input from a user interface 206 to calculate an approximate height and distance value of the target source 101 in relation to the mobile device 100 position. The calculated height and distance value from the captured image and/or received input data may be applied to the adaptive beamforming to adjust the sensitivity of the one or more microphones 208 (e.g., 208*a* and 208*b*) to aim 501 toward the target source 101.

For example, microphone 208*a* may receive the target source audio data at a target source amplitude via adaptive beamforming. The mobile device 100 may assign microphone 208*d* via adaptive beamforming to adjust the sensitivity of the microphone 208*d* for receiving the off-axis noise 512 (e.g., the right side of the mobile device 100) at a noise amplitude. The mobile device may determine a high amplitude difference between the target source amplitude and the noise amplitude. The high amplitude difference creates a signal of higher SNR, therefor cancelling the surrounding off-axis noise 512 while improving the amplification of the target source 101.

Figure 6:
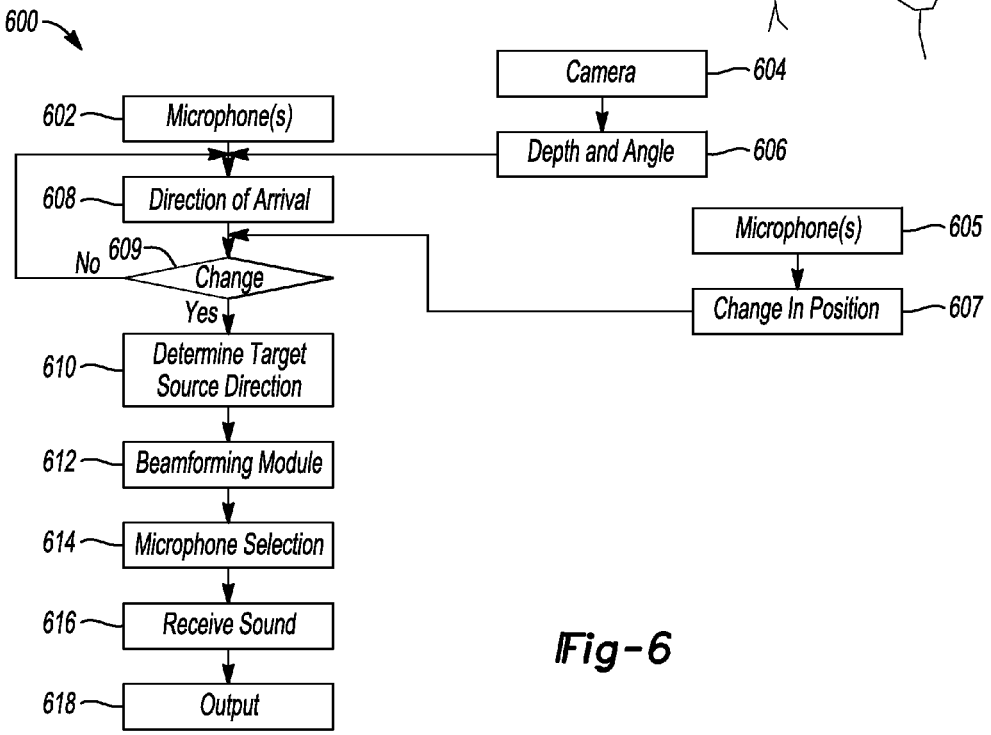
FIG. 6 is a flow chart illustrating a method for controlling one or more microphones to receive sound from the target source according to an embodiment.

FIG. 6 is a flow chart illustrating a method 600 for controlling one or more microphones 208 to receive sound from the target source 101 according to an embodiment. The method 600 may be implemented on the mobile device 100.

In operation 602, the mobile device 100 includes one or more microphones 208 that may receive sound from a variety of sources including, but not limited, a television speaker, a presenter, and/or an audio amplification system. The mobile device 100 may receive an image from the integrated camera 204 capturing the desired target source 101 of sound in operation 604. The mobile device 100 may determine depth and angle based on the image of the target source 101 of sound in operation 606.

In operation 608, the mobile device 100 may determine a direction of arrival based on received sound at the one or more microphones 208 via adaptive beamforming and/or the captured image of the target source 101. The mobile device 100 may process the captured image and/or arrival of the received sound to determine parameter data associated with the target source 101 position in relation to the mobile device 100.

In operation 605, the one or more microphones 208 may also receive sound to determine if the target source 101 is a stationary object or is a moving object. The one or more microphones 208 may also be used to determine if the mobile device 100 has been moved from its resting position. The mobile device 100 may determine change in position of the target source 101 and/or mobile device 100 with the received sound input from the one or more microphones 208 as set forth in operation 607.

In operation 609, the mobile device 100 may determine if there has been a change in position of the target source 101 and/or the mobile device 100 resting position based on analysis of the received sound input from the one or microphones 208. In response to the detected change, the mobile device 100 may determine a position of the target source 101 based on the received sound input direction of arrival in operation 610.

In operation 612, the beamforming module 220 of the mobile device 100 may determine the adjusted sensitivity of the one or more microphones 208 based on the determined target source 101 direction. The beamforming module 220 may select adjustment of sensitivity for one or more microphones 208 on the mobile device 100 to aim towards the target source 101. The one or more microphones 208 aimed at the target source 101 may receive the desired sound based on the adjusted sensitivity in operation 616. The mobile device 100 may process the received sound to eliminate noise and/or amplify the desired sound via adaptive beamforming. In operation 618, the mobile device 100 may transmit the received sound to one or more outputs on the mobile device 100 including, but not limited to, speakers 216, headphone auxiliary port 224, and/or a combination thereof.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A computer-program product embodied in a non-transitory computer read-able medium that is programmed for transmitting audio data to one or more outputs for audio playback, the computer-program product comprising instructions that, when executed by a processor, cause the processor to perform operations comprising:

receiving at least one of a digital image of a target source from a camera and distance and angle information of the target source at a user interface;

generating one or more first coordinates representing a location of the target source based on the at least one of the digital image and the distance and angle information;

receiving audio data from the target source in response to adjusting a sensitivity of a first microphone based on the one or more first coordinates;

transmitting the audio data to one or more outputs for audio playback;

receiving information from a gyroscope to determine if a mobile device has moved;

updating the one or more first coordinates based on the information to provide one or more second coordinates; and adjusting the sensitivity of the first microphone via adaptive beamforming based on the one or more second coordinates.

2. The computer-program product of claim 1, further comprising instructions for adjusting the sensitivity of the first microphone via adaptive beamforming based on the one or more first coordinates.

3. The computer-program product of claim 1, further comprising instructions for receiving the audio data at the first microphone including a first amplitude; receiving an off-axis noise at a second amplitude that is not from the target source with adaptive beamforming at a second microphone; and determining a difference between the first amplitude and the second amplitude to provide a resultant amplitude.

4. The computer-program product of claim 3, further comprising instruction for adding the resultant amplitude to the first amplitude to increase a signal-to-noise ratio of the audio data.

5. The computer-program product of claim 1, further comprising instructions for adjusting a sensitivity of a second microphone via adaptive beamforming based on the one or more first coordinates and receiving audio data from the target source in response to adjusting the sensitivity of the second microphone.

6. The computer-program product of claim 1, further comprising instructions for requesting additional position data at the user interface; updating the one or more first coordinates based on the addition position data to provide one or more second coordinates; and adjusting the sensitivity of the first microphone via adaptive beamforming based on the one or more second coordinates.

7. The computer-program product of claim 6, wherein the addition position data includes at least one of distance, angle, and height of the target source.

8. The computer-program product of claim 7, further comprising instructions for receiving distance and angle data based on a mobile device position to the target source at the user interface; and update the one or more coordinates based on the received distance and angle data.

9. The computer-program product of claim 8, wherein instructions for receiving distance and angle data based on a mobile device position include the instructions based on the information from the gyroscope.

10. The computer-program product of claim 1, further comprising additional instructions for receiving input from one or more sensors; and monitor if a mobile device has been moved using the received input.

11. The computer-program product of claim 10, wherein the one or more sensors is at least one of a gyroscope and an accelerometer.

12. A mobile device for receiving audio data from a target source for playback at one or more outputs, the device comprising:

a camera; and at least one control module configured to:

receive a digital image of a target source from the camera;

generate one or more first coordinates representing a location of the target source based on the digital image;

receive audio data from the target source in response to adjusting a sensitivity of a first microphone based on the one or more first coordinates;

transmit the audio data to one or more outputs for audio playback;

receive movement information from at least one of a gyroscope, an accelerometer, or both to determine if the control module has moved;

update the one or more first coordinates based on the movement information to provide one or more second coordinates; and adjusting the sensitivity of the first microphone via adaptive beamforming based on the one or more second coordinates.

13. The mobile device of claim 12, wherein the at least one control module is further configured to adjust a sensitivity of a second microphone based on the one or more first coordinates and receive audio data from the target source in response to adjusting the sensitivity of the second microphone.

14. The mobile device of claim 13, wherein the at least one control module is further configured to adjust the sensitivity of at least one of the first microphone and the second microphone via adaptive beamforming based on the one or more first coordinates.

15. The mobile device of claim 12, wherein the at least one control module is further configured to receive the audio data at the first microphone including a first amplitude; receive an off-axis noise at a second amplitude that is not from the target source with adaptive beamforming at a second microphone; determine a difference between the first amplitude and the second amplitude to provide a resultant amplitude; and add the resultant amplitude to the first amplitude to increase a signal-to-noise ratio of the audio data.

16. The mobile device of claim 12, wherein the at least one control module is further configured to request for target source location information at a user interface; update the one or more first coordinates based on the target source location information to provide one or more second coordinates; and adjust the sensitivity of the first microphone via adaptive beamforming based on the one or more second coordinates, wherein the target source location information is at least one of distance, angle, and height of the target source.

17. A method for transmitting audio data to one or more outputs for audio playback, the method comprising:

receiving, via a control module, at least one of a first digital image of a target source from a camera and distance and angle information of the target source at a user interface;

generating one or more first coordinates representing a location of the target source based on the at least one of the first digital image and the distance and angle information;

adjusting a sensitivity of a first microphone via adaptive beamforming based on the one or more first coordinates;

receiving audio data from the target source in response to adjusting the sensitivity of the first microphone;

transmitting the audio data to one or more outputs for audio playback;

receiving information from a gyroscope to determine if the control module has moved;

updating the one or more first coordinates with the information to provide one or more second coordinates; and adjusting the sensitivity of the first microphone via adaptive beamforming based on the one or more second coordinates.

18. The method of claim 17, further comprising receiving the audio data at the first microphone including a first amplitude; receiving an off-axis noise at a second amplitude that is not from the target source with adaptive beamforming at a second microphone; determining a difference between the first amplitude and the second amplitude to provide a resultant amplitude; and adding the resultant amplitude to the first amplitude to increase a signal-to-noise ratio of the audio data.

19. The method of claim 17, further comprising:

transmitting a request for a second digit image of the target source;

receiving the second digital image of the target source;

generating one or more second coordinates based on the second digital image of the target source; and adjusting the sensitivity of the first microphone via adaptive beamforming based on the one or more second coordinates.

20. A computer-program product embodied in a non-transitory computer read-able medium that is programmed for transmitting audio data to one or more outputs for audio playback, the computer-program product comprising instructions that, when executed by a processor, cause the processor to perform operations comprising:

receiving at least one of a digital image of a target source from a camera and distance and angle information of the target source at a user interface;

generating one or more first coordinates representing a location of the target source based on the at least one of the digital image and the distance and angle information;

receiving audio data from the target source in response to adjusting a sensitivity of a first microphone based on the one or more first coordinates; and transmitting the audio data to one or more outputs for audio playback;

receiving accelerometer information from an accelerometer to determine if a mobile device has moved;

updating the one or more first coordinates based on the accelerometer information to provide one or more second coordinates; and adjusting the sensitivity of the first microphone via adaptive beamforming based on the one or more second coordinates.

21. The computer-program product of claim 20, further comprising operations including adjusting a sensitivity of a second microphone based on the one or more first coordinates and receive audio data from the target source in response to adjusting the sensitivity of the second microphone.

22. The computer-program product of claim 21, further comprising operations including adjusting the sensitivity of at least one of the first microphone and the second microphone via adaptive beamforming based on the one or more first coordinates.

23. The computer-program product of claim 20, further comprising operations including receive the audio data at the first microphone including a first amplitude; receiving an off-axis noise at a second amplitude that is not from the target source with adaptive beamforming at a second microphone; determining a difference between the first amplitude and the second amplitude to provide a resultant amplitude; and adding the resultant amplitude to the first amplitude to increase a signal-to-noise ratio of the audio data.

* * * * *